US005432432A

United States Patent [19]

Kimura

[11] Patent Number: 5,432,432

[45] Date of Patent: Jul. 11, 1995

[54] REFERENCE VOLTAGE GENERATING CIRCUIT WITH TEMPERATURE STABILITY FOR USE IN CMOS INTEGRATED CIRCUITS

[75] Inventor: Katsuji Kimura, Tokyo, Japan

[73] Assignee: NEC Corporation, Tokyo, Japan

[21] Appl. No.: 340,439

[22] Filed: Nov. 14, 1994

Related U.S. Application Data

[63] Continuation of Ser. No. 13,368, Feb. 4, 1993, abandoned.

[30] Foreign Application Priority Data

Feb. 5, 1992 [JP] Japan ..... 4-054224
Feb. 26, 1992 [JP] Japan ..... 4-075215

[51] Int. Cl.[6] ..... G05F 3/16
[52] U.S. Cl. ..... 323/313
[58] Field of Search ..... 323/312, 313, 315, 907

[56] References Cited

U.S. PATENT DOCUMENTS 4,683,414 7/1987 Moore ..... 323/315 X
5,045,773 9/1991 Westwick et al. ..... 323/315 X
5,144,223 9/1992 Gillingham ..... 323/313

FOREIGN PATENT DOCUMENTS 0116114 9/1980 Japan ..... 323/313

OTHER PUBLICATIONS

Low Temperature Coefficient CMOS Voltage Reference Circuits IEICE Trans. Fundamentals, vol. E77-A, Feb. 1994.

Blauschild et al, "An NMOS Voltage Reference", IEEE International Solid-State Circuits Conference, Feb. 1978, pp. 50-51.

*Primary Examiner*—Steven L. Stephan
*Assistant Examiner*—E. To
*Attorney, Agent, or Firm*—Leydig, Voit & Mayer

[57] ABSTRACT

M1 and M2, because their capacity ratio is $1:K_1$, have different gate-source voltages. M3 and M4, which constitute a current mirror circuit, have a capacity ratio of $K_2:1$. Thus, M1 and M2 are driven at a current ratio of $K_2:1$. As a result, the temperature dependence of mobility and that of threshold voltage can cancel each other to make it possible to realize on a CMOS integrated circuit a reference voltage generating circuit with reduced temperature dependence. As the output reference voltage, $V_{REF}$ will be used if a resistor R1 is present, or $V_{REF}$ will be used if the resistor R1 is dispensed with. The output may as well be taken out of the gate of M2 ($V_{REF2}$), or out of the drain of M2 in which case the drain is provided with a resistor. Q1 and Q2, which are PNP transistors, have an emitter size ratio (Q1:Q2) of $1:K_1$, and their bases are commonly connected and grounded via an analog ground $V_{AG}$, their collectors being also grounded. Thus Q1 and Q2 are diode-connected. P channel MOS transistors (M1 and M2) and N channel MOS transistors (M3 and M4) constitute a current mirror circuit each, and their mirror ratio (M1:M2=M3:M4) is $K_2:1$. In these two current mirror circuits, transistors equal in capacity (M1 and M3, and M2 and M4) are connected to each other in series.

14 Claims, 4 Drawing Sheets

REFERENCE VOLTAGE GENERATING CIRCUIT WITH TEMPERATURE STABILITY FOR USE IN CMOS INTEGRATED CIRCUITS

This application is a continuation application Ser. No. 08/013,368, filed Feb. 4, 1993 now abandoned.

BACKGROUND OF THE INVENTION

The present invention relates to a reference voltage generating circuit for use in the generation of a reference voltage in a constant-voltage circuit in C-MOS technology.

As is well known to persons skilled in the art, the most commonly used reference voltage generating circuit according to the prior art is a widlar band-gap reference circuit, but no reference voltage generating circuit solely consisting of MOS transistors is known to be available for practical use. A paper on an NMOS reference voltage generating circuit utilizing the threshold voltage difference between an enhancement MOS transistor and a depletion MOS transistor was published (1978, ISSCC, No. WAM 3.5), but its performance characteristics are not adequate for practical application either.

MOS transistors, however, have many advantages, and it is called for to develop a reference voltage generating circuit that can be realized on a CMOS integrated circuit. Notably, such a circuit should be excellent in temperature performance, but, since MOS transistors are significantly uneven in manufactured state and, moreover, their temperature dependence is curvilinear unlike bipolar transistors whose temperature dependence is linear, how to control this characteristic possesses a major problem.

On the other hand, among reference voltage generating circuits consisting of MOS and bipolar transistors, what is illustrated in FIG. 8 is known, for instance. This reference voltage generating circuit is commonly known as a band-gap voltage reference circuit, and FIG. 8 illustrates an example realized by executing a CMOS process over an N type substrate with a view to large-scale integration. Its configuration centers on an OP amplifier 31 and so-called parasitic transistors (Q1 and Q2). Its outline will be described below.

In FIG. 8, the base-emitter voltage $V_{BE1}$ of Q1 is represented by equation (1), and the base-emitter voltage $V_{BE2}$ of Q2, by equation (2). In equations (1) and (2), $I_{S1}$ and $I_{S2}$ are the saturation currents of Q1 and Q2, respectively, $V_T$ being equal to kT/q, where k is Boltzmann's constant, q, the charge of an electron and T, absolute temperature.

$$V_{BE1}=V_T \ln(I_1/I_{S1}) \quad (1)$$

$$V_{BE2}=V_T \ln(I_2/I_{S2}) \quad (2)$$

From equations (1) and (2) are derived equation (3), which represents the difference voltage $\Delta V_{BE}$ of the base-emitter voltages of Q1 and Q2.

$$\Delta V_{BE}=V_{BE1}-V_{BE2}=V_T \ln\{(I_1/I_2)(I_{S2}/I_{S1})\} \quad (3)$$

Since Q1 and Q2 are equal here in emitter area, $I_{S1}$ equals $I_{S2}$. Therefore, the difference voltage $\Delta V_{BE}$ is represented by equation (4).

$$\Delta V_{BE}=V_T \ln(I_1/I_2) \quad (4)$$

Further, $I_2=\Delta V_{BE}/R_3$. Therefore, the output reference voltage $V_{REF}$ can be obtained by equation (5).

$$\begin{aligned} V_{REF} &= (R_1+R_3)I_2+V_{BE2} \\ &= (1+R_1/R_3)\Delta V_{BE}+V_{BE2} \\ &= V_{BE1}+(R_1/R_3)\Delta V_{BE} \end{aligned} \quad (5)$$

The temperature dependence of this output reference voltage $V_{REF}$ can be represented by equation (6) because the ratio $R_1/R_3$ is independent of temperature.

$$\frac{dV_{REF}}{dT}=\frac{dV_{BE1}}{dT}+\left(\frac{R_1}{R_3}\right)\frac{d\Delta V_{BE}}{dT} \quad (6)$$

The first term of the right side of this equation (6) is approximately −2 mV/deg. Because the ratio between $I_1$ and $I_2$ in equation (4) can be considered to be substantially constant and is logarithmically compressed, the temperature dependence of the difference voltage $\Delta V_{BE}$ is represented by equation (7).

$$d\Delta V_{BE}/d\,T \approx +0.085\ mV/\deg \times \ln(I_1/I_2) \quad (7)$$

Therefore, if $(R_1/R_3)\ln(I_1/I_2)$ is set to be 23.5, $dV_{REF}/dT$ will be approximately 0. If $V_{BE1}$ is approximately 0.6 V here, $V_{REF}$ can be calculated to be approximately 1.211 V.

The above-described prior art reference voltage generating circuit illustrated in FIG. 8, on account of its use of an OP amplifier as the control element, involves the problems of a large circuit scale and a large drain current.

SUMMARY OF THE INVENTION

An object of the present invention, therefore, is to provide a reference voltage generating circuit whose configuration is suitable for integration into a CMOS circuit.

Another object of the invention is to provide a reference voltage generating circuit of a new configuration combining MOS and bipolar transistors, which makes it possible to reduce the circuit scale and the drain current.

According to a first aspect of the invention, there is provided a reference voltage generating circuit equipped with two MOS transistors differing in capacity ratio and a current mirror circuit for driving said two MOS transistors with different currents, wherein, between said two MOS transistors, the drain of one and the gate of the other are commonly connected; one has its gate connected to one of the current output ends of said current mirror circuit either via a first resistor or directly and the drain connected to the gate via a second resistor; the other has its drain connected to the other current output end of said current mirror circuit and the source directly grounded; and an output terminal is provided at the connection end of said first resistor and said current mirror circuit, or at the connection end of the gate of one of the transistors and said current mirror circuit.

According to a second aspect of the invention, there is provided a reference voltage generating circuit equipped with two transistors of which the emitter area ratio is 1:$K_1$ and the bases are commonly connected and which operate as a diode; a first current mirror circuit consisting of two P channel FET's whose capacity ratio is $K_2$:1, and a second current mirror circuit consisting of two N channel FET's whose capacity ratio is $K_2$:1, wherein FET's of equal capacities in said first and second current mirror circuits are connected to each other in series; to the output ends of the FET's whose capacity is $K_2$ is connected via a first resistor the emitter of the transistor, out of said two transistors, whose emitter area ratio is 1; and to the output ends of the FET's whose capacity is 1 is connected via a series circuit of second and third resistors the emitter of the transistor, out of said two transistors, whose emitter area ratio is $K_1$.

BRIEF DESCRIPTION OF THE DRAWINGS

The above-mentioned and other objects, features and advantages of the present invention will become more apparent from the following detailed description when taken in conjunction with the accompanying drawings, wherein.

DETAILED DESCRIPTION OF THE PREFERRED EMBODIMENTS

Figure 1:
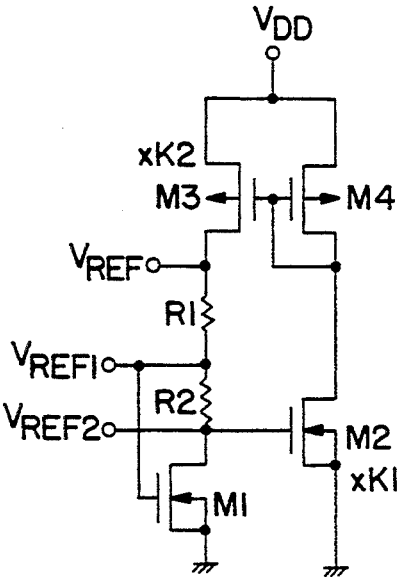
FIG. 1 is a diagram illustrating a reference voltage generating circuit which is a first embodiment of the first aspect of the invention.

In FIG. 1, a reference voltage generating circuit basically includes two n-channel NOS transistors (M1 and M2) provided on the grounding side and two p-channel MOS transistors (M3 and M4) provided on the D.C. power source $V_{DD}$ side. Thus it has a CMOS configuration.

The M1:M2 capacity ratio (the ratio of gate width/gate length) is 1:$K_1$. The drain of M1 and the gate of M2 are commonly connected. Of M1, the source is directly grounded, the gate is connected to the source of M3 via a (first) resistor R1, and the gate is connected to the resistor R1 via a (second) resistor R2. Thus, the gate and the drain are connected to each other via the resistor R2, and the drain is connected to the source of M3 via a series circuit of the resistors R2 and R1. Of M2, the source is directly grounded, and the drain is connected to the source of M4.

Then, the M3:M4 capacity ratio is $K_2$:1. Their drains are commonly connected to the D.C. power supply $V_{DD}$, and their gates are commonly connected. The gate and source of M4 are directly connected. In short, M3 and M4 constitute a current mirror circuit well known to those skilled in the art, and drives M1 and M2 in a current ratio of $K_2$:1.

In FIG. 1, the resistor R1 can be dispensed with and, if it is, the gate of M1 will be directly connected to the source of M3. Therefore, the output terminal for the output voltage of the reference voltage generating circuit is provided at the connection end of the resistor R1 and the source of M3 (referred to as $V_{REF}$ in the drawing) or, in the absence of the resistor R1, at the connection end of the resistor R2 and the source of M3, i.e. the gate of M1 (referred to as $V_{REF1}$ in the drawing). In either the configuration of FIG. 1 or the configuration in which the resistor R1 is absent, the output terminal can be provided at the gate of M2 (referred to as $V_{REF2}$ in the drawing).

Figure 2:
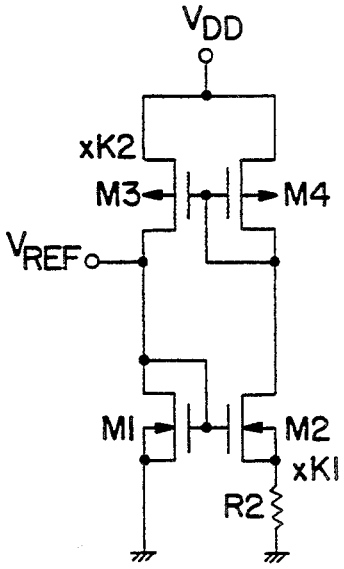
FIG. 2, a diagram illustrating a reference voltage generating circuit which is a second embodiment of the first aspect of the invention.

Further, the configuration of FIG. 1, in which the resistor R1 may be either absent or present, can be replaced by a configuration in which the resistor R2 is transferred to between the source of M2 and the ground, i.e., the gate and the drain of M1 are directly connected and the source of M2 is grounded via a (third) resistor R2 as illustrated in FIG. 2, wherein the resistor R1 is absent.

Figure 3:
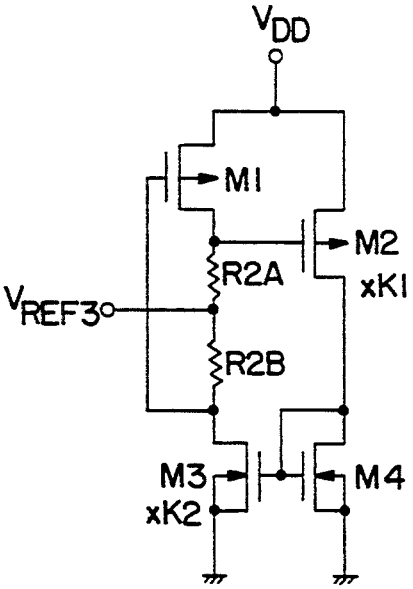
FIG. 3, a diagram illustrating a reference voltage generating circuit which is a third embodiment of the first aspect of the invention.

The output terminal can be provided at the middle point of a resistance pattern, which consists of the resistor R2, in the configuration of FIG. 1, in which the resistor R1 may be either absent or present. FIG. 3, for instance, shows a configuration in which the p-channel and the n-channel are interchanged. In this configuration, a resistor $R2_A$ and a resistor $R2_B$ have resulted from the bisecting of the resistor R2, and the output terminal is provided at the middle point between them (referred to as $V_{REF3}$ in the drawing).

Figure 4:
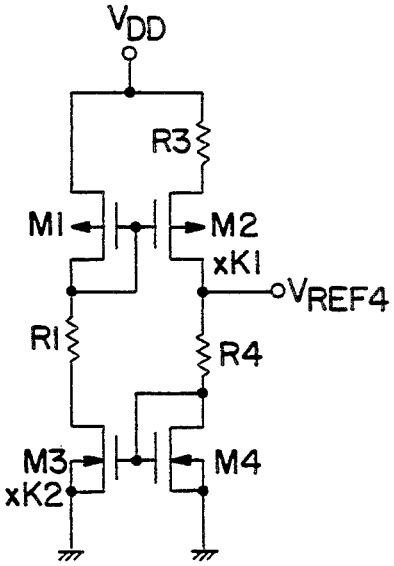
FIG. 4, a diagram illustrating a reference voltage generating circuit which is a fourth embodiment of the first aspect of the invention.

Further, the configuration of FIG. 1, in which the resistor R1 may be either absent or present, can be replaced by a configuration in which the drain of M2 is connected to the source of M4 via a (fourth) resistor, and the output terminal may be provided at the connection end of this fourth resistor and the source of M4. FIG. 4, for instance, shows a configuration in which the p-channel and the n-channel are interchanged. In this configuration, a resistor $R2_A$ and a resistor $R2_B$ have resulted from the bisecting of the resistor R2, and the output terminal is provided at the connection end of the (fourth) resistor R4 and the source of M4 (referred to as $V_{REF4}$ in the drawing).

The operation of the circuit will be described below with reference to FIG. 1. The difference voltage between the gate-source voltage $V_{GS1}$ of M1 and the gate-source voltage $V_{GS2}$ of M2 being represented by $\Delta V_{GS}$, the output reference voltage $V_{REF}$ can be represented by equation (8).

$$V_{REF} = V_{GS1} + \frac{R_1}{R_2}\Delta V_{GS} \quad (8)$$

The drain current $I_1$ of M1 and the drain current $I_2$ of M2 are determined by the capacity ratio between M3 and M4 ($K_2$:1) constituting the current mirror circuit, $I_1$ being equal to $K_2I_2$. The drain current $I_1$ of M1 is represented by equation (9) using the gate-source voltage $V_{GS1}$, a threshold voltage $V_{THN}$ and a transconductance $\beta_N$, and the drain current $I_2$ of M2 is represented by equation (10) using a transconductance $K_1\beta_N$, the gate-source voltage $V_{GS2}$ and the threshold voltage $V_{THN}$. The transconductance $\beta_N$ is represented by equation (11) using a mobility $\mu_N$, a gate oxide film capacity per unit area $C_{OX}$, a gate width W and a gate length L.

$$I_1=\beta_N(V_{GS1}-V_{THN})^2 \quad (9)$$

$$I_2=K_1\beta_N(V_{GS2}-V_{THN})^2 \quad (10)$$

$$\beta_N=\mu_N\frac{C_{ox}}{2}\left(\frac{W}{L}\right) \quad (11)$$

Therefore, the difference voltage $\Delta V_{GS}$ can be represented by equation (12), which can be rearranged into equation (13).

$$\Delta V_{GS}=V_{GS1}-V_{GS2} \quad (12)$$

$$=\frac{1}{\sqrt{\beta_N}}\left(\sqrt{I_1}-\sqrt{\frac{I_2}{K_1}}\right.$$

$$=\sqrt{\frac{I_1}{\beta_N}}\left(1-\frac{1}{\sqrt{K_1K_2}}\right)$$

$$=R_2I_1$$

$$\sqrt{I_1}\left\{\frac{1}{\sqrt{\beta_N}}\left(1-\frac{1}{\sqrt{K_1K_2}}\right)-R_2\sqrt{I_1}\right\}=0 \quad (13)$$

Since $I_1$ is not 0 during operation, the drain current $I_1$ can be eventually represented by equation (14).

$$I_1=\frac{1}{\beta_2R_2^2}\left(1-\frac{1}{\sqrt{K_1K_2}}\right)^2 \quad (14)$$

If equations (9) and (14) are substituted into equation (8), the output reference voltage $V_{REF}$ can be represented by equation (15).

$$V_{REF}= \quad (15)$$

$$\frac{1}{\beta_NR_2}\left(1-\frac{1}{\sqrt{K_1K_2}}\right)\left\{1+\frac{R_1}{R_2}\left(1-\frac{1}{\sqrt{K_1K_2}}\right)\right\}+V_{THN}$$

It may be relevant here to consider the temperature dependence of the output reference voltage $V_{REF}$. In the SPICE model, the conductance $\beta_N$ is represented by equation (16) and the mobility $\mu_N$, by equation (17). Incidentally, $\beta_{N0}$ and $\mu_{N0}$ in equations (9) and (10) indicate the values of $\beta_N$ and $\mu_N$, respectively, at $T=T_0$.

$$\beta_N=\beta_{N0}\left(\frac{T}{T_0}\right)^{-\frac{3}{2}} \quad (16)$$

$$\beta_N=\mu_{N0}\left(\frac{T}{T_0}\right)^{-\frac{3}{2}} \quad (17)$$

Therefore, $1/\beta_N$ is represented by equation (18), and the fractional temperature coefficient of $1/\beta_N$ at $T_0=300°$ K. is 5,000 ppm/deg.

$$\frac{1}{\beta_N}=\frac{1}{\beta_{N0}}\left(\frac{T}{T_0}\right)^{\frac{3}{2}} \quad (18)$$

The threshold voltage $V_{THN}$, on the other hand, can be modelled into equation (19), in which $\alpha$ equals $-4$ mV/deg in the standard $V_{THN}$ process or $-2.7$ mV/deg in the low $V_{THN}$ process according to W. M. Penney and L. Lau, MOS Integrated Citcuits Theory, Design, and Systems Applications of MOS LSI (Van Nostrand Company).

$$V_{THN}=V_{THN0}-\alpha(T-T_0) \quad (19)$$

Now, if equations (18) and (19) are substituted into equation (15), the output reference voltage $V_{REF}$ will be represented by equation (20), which can be differentiated with respect to the temperature T to give equation (21), and the fractional temperature coefficient of the output reference voltage $V_{REF}$ ($TC_F(V_{REF})$) at the room temperature $T_0$ of 300° K. can be represented by equation (22), wherein $V_{REF0}$ is the value of $V_{REF}$ at $T=T_0-300°$ K.

$$V_{REF}=\frac{1}{\beta_{N0}R_2}\left(\frac{T}{T_0}\right)^{\frac{3}{2}}\left(1-\frac{1}{\sqrt{K_1K_2}}\right)\times\left\{1+\frac{R_1}{R_2}\left(1-\frac{1}{\sqrt{K_1K_2}}\right)\right\}+V_{THN0}-\alpha(T-T_0) \quad (20)$$

$$\frac{dV_{REF}}{dT}=\frac{1}{\beta_{N0}R_2}\left\{\frac{3}{2}\cdot\frac{1}{T_0}\left(\frac{T}{T_0}\right)^{\frac{1}{2}}-\left(\frac{T}{T_0}\right)^{\frac{3}{2}}\frac{1}{R_2}\frac{dR_2}{dT}\right\}\times\left(1-\frac{1}{\sqrt{K_1K_2}}\right)\left\{1+\frac{R_1}{R_2}\left(1-\frac{1}{\sqrt{K_1K_2}}\right)\right\}-\alpha \quad (21)$$

$$TC_F(V_{REF})=\frac{1}{V_{REF}}\cdot\frac{dV_{REF}}{dT}=\frac{\{5{,}000-TC_F(R)\}(V_{REF0}-V_{THN0})}{V_{REF0}}-\frac{\alpha}{V_{REF0}} \quad (22)$$

Therefore, in order that $TC_F(V_{REF})$ equal 0, equation (22) requires that equation (23) should hold.

$$\{5{,}000-TC_F(R)\}(V_{REF0}-V_{THN0})=\alpha \quad (23)$$

If, for example, $V_{THN0}$ is 0.8 V, $\alpha$ is 2.7 mV/deg and $TC_F(R)$ is 600 ppm/deg, the output reference voltage to make $TC_F(V_{REF})$ equal 0 will be represented by equation (24).

$$V_{REF0}=1.414\text{ V} \quad (24)$$

Then, supposing R1 to be 0, equation (14) will still hold. Whereas the output reference voltage is $V_{REF1}$ in this case, equation (25) holds here because of equation (8), and this case is equal to equation (15) at R1=0.

$$V_{REF1} = V_{GS1} = \frac{1}{\beta_N R_2}\left(1 - \frac{1}{\sqrt{K_1 K_2}}\right) + V_{THN} \quad (25)$$

If equations (18) and (19) are substituted into this equation (25), $V_{REF1}$ will be represented by equation (26), and its temperature dependence, by equation (27). Thus equations (22) and (23) are applicable here, and a value indicated by equation (24) is obtained.

$$V_{REF1} = \frac{1}{\beta_{N0} R_2}\left(\frac{T}{T_0}\right)^{\frac{3}{2}}\left(1 - \frac{1}{\sqrt{K_1 K_2}}\right) + V_{THN0} - \alpha(T - T_0) \quad (27)$$

$$\frac{dV_{REF1}}{dT} = \frac{1}{\beta_{N0} R_2}\left\{\frac{3}{2}\cdot\frac{1}{T_0}\left(\frac{T}{T_0}\right)^{\frac{1}{2}} - \left(\frac{T}{T_0}\right)^{\frac{3}{2}}\frac{1}{R_2}\left(\frac{dR_2}{dT}\right)\right\}\times\left(1 - \frac{1}{\sqrt{K_1 K_2}} - \alpha\right.$$

Further, if the reference voltage is to be taken out of the gate of M2, the output reference voltage will be $V_{REF2}$, which is represented by equation (28).

$$V_{REF2} = V_{GS2} = \frac{1}{\beta_N R_2}\left(1 - \frac{1}{\sqrt{K_1 K_2}}\right)\frac{1}{K_1 K_2} + V_{THN} \quad (28)$$

Comparison of this equation (28) with equation (25) reveals that equation (29) holds, and accordingly the output reference voltage $V_{REF2}$ is represented by equation (30).

$$(V_{REF1} - V_{THN}) = \sqrt{K_1 K_2}\,(V_{REF2} - V_{THN}) \quad (29)$$

$$V_{REF2} = \frac{1}{\sqrt{K_1 K_2}} V_{REF1} + \left(1 - \frac{1}{\sqrt{K_1 K_2}}\right)V_{THN} \quad (30)$$

Because of this equation (30), $TC_F(V_{REF2})$ is smaller than 0 when fractional temperature coefficient $TC_F(V_{REF1})$ is 0. Similarly, when $TC_F(V_{REF1})$ is greater than 0, $TC_F(V_{REF2})$ can be set to be smaller than 0.

Therefore, if the intermediate voltage of the resistor R2 is the output reference voltage $V_{REF3}$ (FIG. 3), $TC_F(V_{REF3})$ will equal 0, and $TC_F(V_{REF1})$ and $TC_F(V_{REF2})$ can be set respectively greater and smaller than 0, there being obtained a voltage whose temperature dependence is positive or negative or zero, provided that, when both $K_1$ and $K_2$ are greater than 1, $V_{REF1}$ is greater than $V_{REF3}$ and $V_{REF3}$ is greater than $V_{REF2}$.

Further, if the output terminal (of the output reference voltage of $V_{REF4}$) is provided at the drain of M2 as shown in FIG. 4, the drain current $I_2$ will be represented by equation (31), and the output reference voltage $V_{REF4}$, by equation (32).

$$I_2 = \frac{K_2}{\beta_p R_3^2}\left(1 - \frac{1}{\sqrt{K_1 K_2}}\right)^2 \quad (31)$$

$$V_{REF4} = V_{GS4} + R_4 I_2 = \frac{\sqrt{K_2}}{\sqrt{\beta_p}}\frac{1}{R_3}\left(1 - \frac{1}{\sqrt{K_1 K_2}}\right)\times\left\{\frac{1}{\sqrt{\beta_N}} + \frac{1}{\sqrt{\beta_p}}\cdot\frac{R_4}{R_3}\left(1 - \frac{1}{\sqrt{K_1 K_2}}\right)\right\} + V_{THN} \quad (32)$$

Therefore, $TC_F(V_{REF4})$ can be set to be 0 for this output reference voltage $V_{REF4}$ as well.

Figure 5:
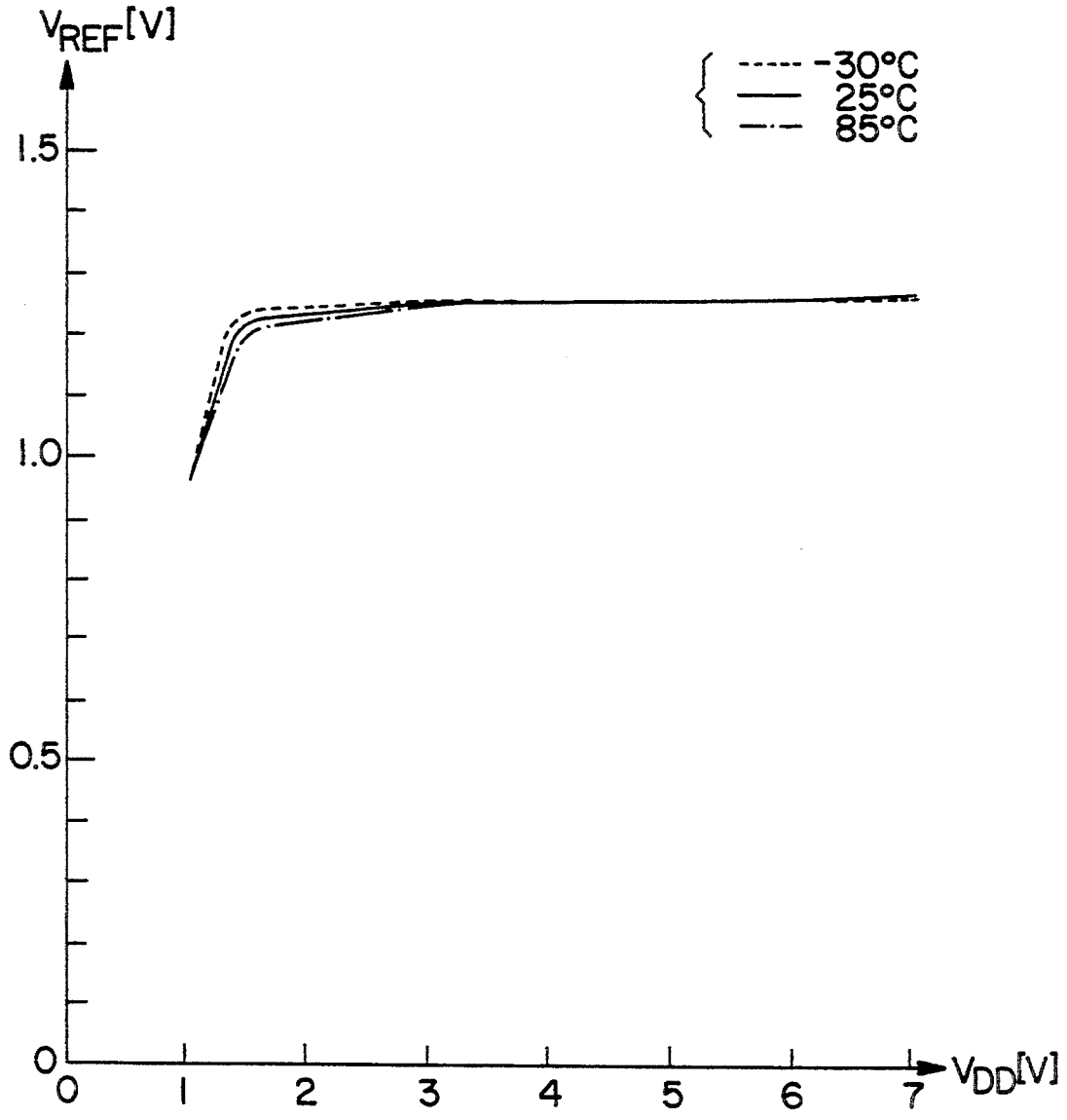
FIG. 5, a temperature dependence diagram (SPICE simulation diagram) of the output reference voltage.

Now, FIG. 5 shows the result of SPICE simulation. It is seen that the temperature dependence of the output reference voltage $V_{REF}$ is approximately 0 when $V_{DD}$ is above 2.5 V. It is supposed here: $K_1=1$, $K_2=2$, R1=3ΩK, R2=4ΩK, $TC_F(R)=600$ ppm/deg, W/L−50 μm/5 μm, and the oxide film thickness $t_{ox}=280$ angstroms.

As described above, the reference voltage generating circuit according to the first aspect of the present invention, in which two MOS transistors differing in capacity ratio, i.e. differing in gate-source voltage, are driven at different amperages, makes it possible for the temperature dependence of mobility and that of threshold voltage to cancel each other and the temperature dependence of the output reference voltage can be thereby reduced. Therefore, the invention has the benefit of providing a reference voltage generating circuit having a suitable configuration for realization on a CMOS integrated circuit.

Next will be described another reference voltage generating circuit according to the second aspect of the invention.

Figure 6A:
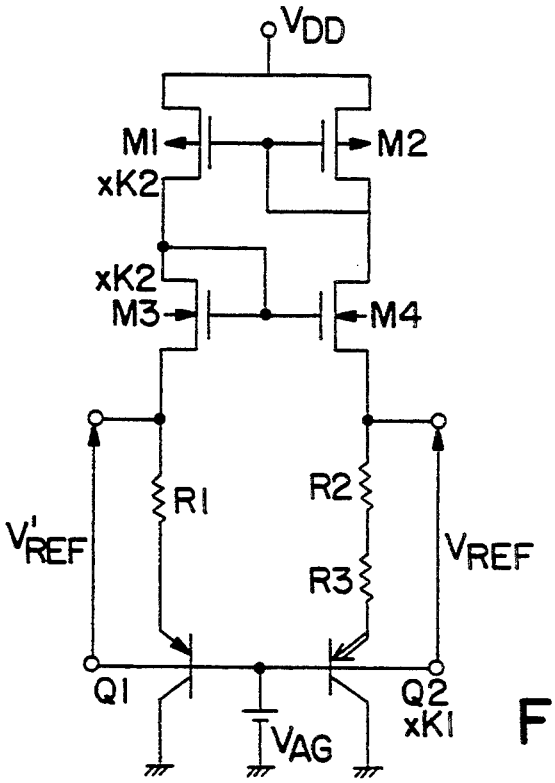
FIGS. 6A, 6B and 6C, diagrams illustrating reference voltage generating circuits representative of a first embodiment of the second aspect of the invention.
Figure 8:
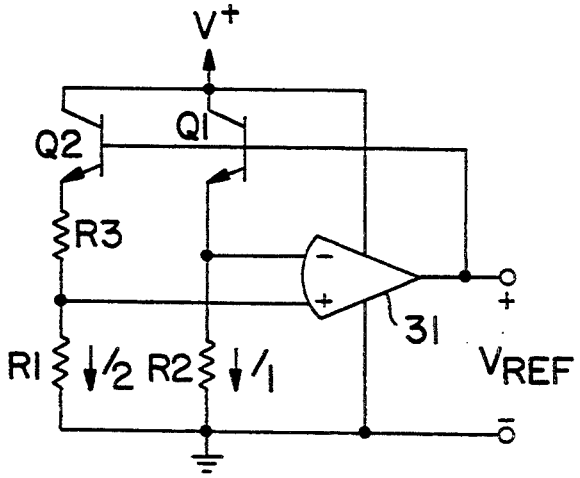
FIG. 8 (PRIOR ART)
FIG. 8, a diagram illustrating a reference voltage generating circuit according to the prior art.

FIG. 6A illustrates a reference voltage generating circuit which is one embodiment of the second aspect of the invention. Although the same reference codes are used for transistors as in FIG. 8, this does not mean that the same transistors are used. The same symbols are used for other elements as well for the convenience of description, but this does not mean that they are the same elements either. The same applies hereinafter.

This reference voltage generating circuit primarily consists of two PNP transistors (Q1 and Q2) and two current mirror circuits [(M1 and M2) and (M3 and M4)].

The two transistors Q1 and Q2, whose emitter size ratio (Q1:Q2) is 1:$K_1$, have their bases commonly connected and the grounded via an analog ground $V_{AG}$, their collectors being also grounded. Thus, these Q1 and Q2 are diode-connected. The analog ground $V_{AG}$ may be dispensed with.

One (first) current mirror circuit consists of MOS transistors (M1 and M2), which are P channel FET's, and the capacity ratio (mirror ratio) between them (M1:M2) is $K_2$:1. The other (second) current mirror circuit consists of MOS transistors (M3 and M4), which are N channel FET's, and the capacity ratio (mirror ratio) between them (M3:M4) is $K_2$:1. These two current mirror circuits constitute a single current mirror circuit through the pairing of transistors equal in capacity (M1 and M3, and M2 and M4) in series connection.

In the illustrated example, one (first) current mirror circuit (M1 and M2) is arranged on the power source $V_{DD}$ side, and the other (second) current mirror circuit (M3 and M4), on the driving side. Thus in the second current mirror circuit (M3 and M4), the source of the transistor M3, whose capacity is $K_2$, is connected to the emitter of the transistor Q1, whose emitter size ratio is 1, via a (first) resistor R1, and the source of the transistor M4, whose capacity is 1, is connected to the emitter of the transistor Q2, whose emitter size ratio is $K_1$, via a series circuit of a (second) resistor R2 and another (third) resistor R3.

In the above-described configuration, the current flowing through the resistor R1 being represented by $I_1$, and that flowing through the resistors R2 and R3 by $I_2$, $I_1$ is equal to $K_2 \times I_2$ because the mirror ratio of M1 and M2 of the first current mirror circuit is $K_2$:1. As the mirror ratio of M3 and M4 of the second current mirror circuit also is $K_2$:1, the source voltage $V_{REF}$ of M4 and the source voltage $V_{REF}'$ of M3 are equal.

Here, the base-emitter voltage $V_{BE1}$ of Q1 is represented by equation (33), and the base-emitter voltage $V_{BE2}$ of Q2, by equation (34), so that the differential voltage $\Delta V_{BE}$ can be represented by equation (35).

$$V_{BE1} = V_T \ln (K_2 I_2 / I_s) \tag{33}$$

$$V_{BE2} = V_T \ln I_2 / (K_1 I_s) \tag{34}$$

$$\Delta V_{BE} = V_{BE1} - V_{BE2} = V_T \ln (K_1 K_2) \tag{35}$$

Further, since $V_{REF}$ is equal to $V_{REF}'$, $I_2$ equals $V_{BE}/R_3$. Therefore, the output reference voltage $V_{REF}'$ can be represented by equation (36).

$$\begin{aligned} V_{REF} &= V_{BE2} + (1 + R_2/R_3)\Delta V_{BE} \\ &= V_{BE1} + (R_2/R_3)\Delta V_{BE} \\ &= V_{BE1} + (R_1/R_3)K_2 \Delta V_{BE} \end{aligned} \tag{36}$$

The temperature dependence of this output reference voltage $V_{REF}$ is represented by equation (37).

$$\begin{aligned} dV_{REF}/dT &= dV_{BE1}/dT + (R_2/R_3) d\Delta V_{BE}/dT \\ &= dV_{BE1}/dT + (R_1/R_3) K_2 d\Delta V_{BE}/dT \end{aligned} \tag{37}$$

In equation (37) here, $dV_{BE1}/dT$ is approximately 2 mV/deg, and $dV_{BE}/dT$ is 0.085 mV/deg. Therefore, if $(R_2/R_3)1\ n(K_1K_2) = (R_1/R_3)K_2\ 1\ n(K_1K_2)$ is set to be 23.5, $d_{REF}/dT$ will be approximately 0. If the value of $V_{BE1}$ is about 0.6 V at this time, $V_{REF}$ will be approximately 1.211 V. Thus, there is realized a reference voltage generating circuit having comparable performance characteristics to what is illustrated in FIG. 3.

Figure 6B:
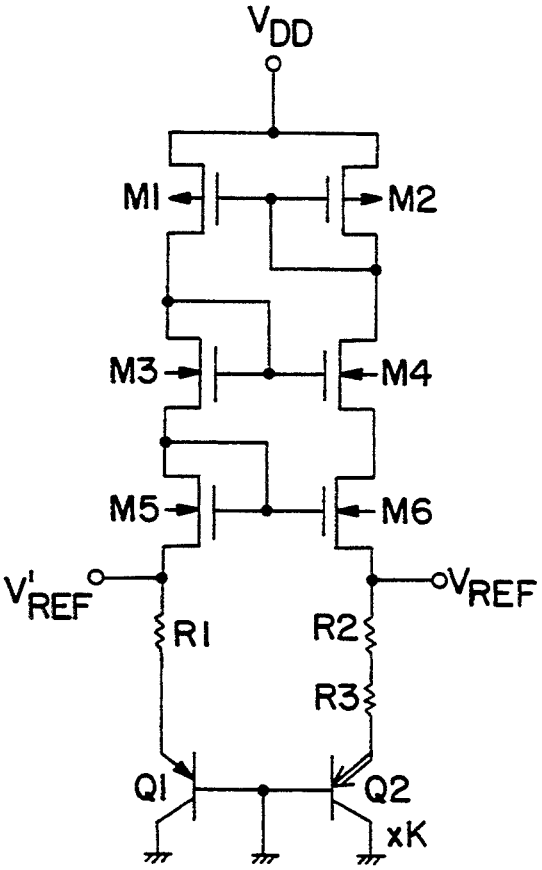
Figure 6C:
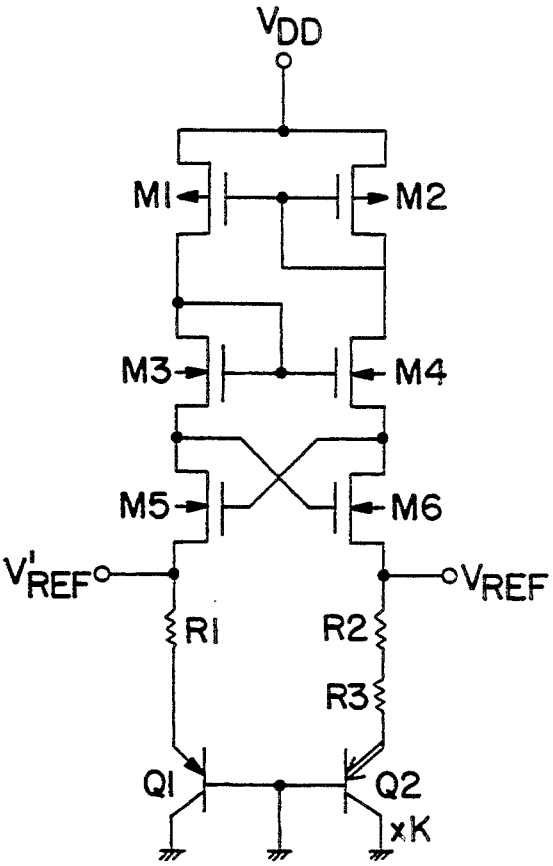

FIG. 6B shows a reference voltage generating circuit according to another embodiment of the second aspect of the present invention in which a current mirror circuit composed of MOS transistors (M5 and M6) is added to improve the regulation efficiency. FIG. 6C shows a reference voltage generating circuit according to a further embodiment of the second aspect of the present invention in which the so-called cross-coupled trrnsistors (M5 and M6) are added to improve the regulation efficiency further, compared with the FIG. 6B circuit.

Figure 7:
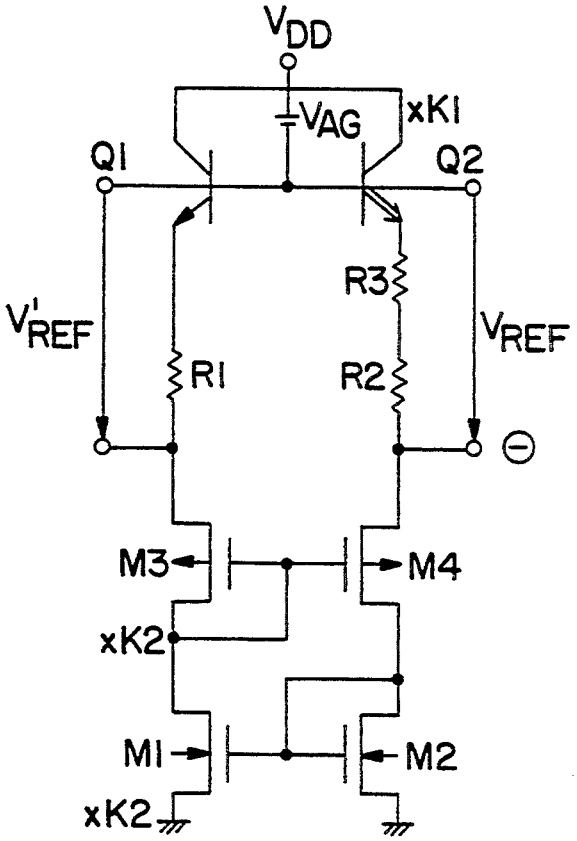
FIG. 7, a diagram illustrating a reference voltage generating circuit which is a second embodiment of the second aspect of the invention.

Next, FIG. 7 illustrates a reference voltage generating circuit which is a second embodiment of the second aspect of the invention. This circuit is a variation of the above-described first embodiment illustrated in FIG. 6, of which the PNP transistors are replaced by NPN transistors, the P channel MOS transistors, by N channel MOS transistors, and the N channel MOS transistors, by P channel MOS transistors, and has comparable performance characteristics.

This reference voltage generating citcuit can be realized in any one of three ways. First, individual parts can be assembled into a circuit. As the circuit dimensions are small, if the circuit is to be used by itself, this option has its own advantages. Second, the circuit can be realized by a CMOS process. The configuration of FIG. 6 can be applied to a CMOS integrated circuit using a P substrate, while that of FIG. 7 can be applied to a CMOS integrated circuit using an N substrate. In these cases, so-called parasitic transistors will be used as Q1 and Q2, and the analog ground $V_{AG}$, if necessary, will be supplied from outside. A third option is the use of a Bi-CMOS process to form bipolar transistors and MOS transistors over the same substrate.

As described above, the reference voltage generating circuit according to the second aspect of the present invention, using no OP amplifier, is composed of two transistors differing in emitter size and operating as a diode, and a current mirror circuit consisting of two current mirror circuits separately driving the two transistors via resistors, each of the two current mirror circuits comprising two P (or N) channel FET's and FET's of equal capacities being paired in series connection. Accordingly, it has the benefit of enabling both the circuit size and the circuit current to be reduced.

What is claimed is:

1. A reference voltage generating circuit with temperature stability for use in CMOS integrated circuits, the reference voltage generating circuit comprising:
   - current mirror circuit means for providing first and second mirror currents;
   - first and second transistor means respectively driven by said first and second mirror currents and having differing capacities, wherein each of said first and second transistor means comprises a MOS transistor;
   - means for generating a reference voltage having temperature stability, the reference voltage generating means being coupled to said first and second transistor means; and
   - means for outputting the reference voltage.

2. The reference voltage generating circuit as claimed in claim 1 wherein said current mirror circuit means comprises at least one pair of current mirror transistors.

3. The reference voltage generating circuit as claimed in claim 1 wherein said current mirror circuit means comprises two cross-coupled transistors.

4. The reference voltage generating circuit as claimed in claim 1 wherein the means for generating a reference voltage includes a resistor, the current mirror circuit means are third and fourth transistors having commonly connected gates, the third and fourth transistors respectively driving the first and second transistor means, and wherein a source of the first transistor means is connected to a ground and a gate and a drain of the first transistor means are commonly connected, and a source of the second transistor means is connected to a ground through the resistor and a gate of the second transistor means is commonly connected with the gate of the first transistor means.

5. The reference voltage generating circuit as claimed in claim 1 wherein the reference voltage generating means includes a resistor, wherein the current mirror circuit means are third and fourth transistors respectively outputting the first and second mirror currents to drains of the first and second transistor means, the first and second transistor means and the third and fourth transistors are MOS transistors, a source of the first transistor means being connected to a ground, and a gate and a drain of the first transistor means being commonly connected via the resistor, the second transistor means having a source connected to the ground, a gate of the second transistor means being connected to the drain of the first transistor means, the first transistor means having a different gate to source voltage than the second transistor means and the third transistor having a different gate to source voltage than the fourth transistor.

6. The reference voltage generating circuit as claimed in claim 1 wherein the first and second mirror currents are different.

7. The reference voltage generating circuit as claimed in claim 1 wherein said current mirror circuit means, said first and second transistor means, said means for generating a reference voltage, and said reference voltage generating means are fabricated on a CMOS integrated circuit using MOS technology and provide means for reducing temperature variations in the reference voltage.

8. A reference voltage generating circuit with temperature stability for use in CMOS integrated circuits, the reference voltage generating circuit comprising:

a current mirror circuit having first and second outputs respectively outputting first and second currents wherein the first current differs from the second current;

first and second MOS transistors differing in capacity, each having drains respectively coupled to the first and second outputs, the gate of the second MOS transistor being connected to the drain of the first MOS transistor, the source of the first MOS transistor being coupled to a ground, the gate of the first MOS transistor being coupled to one of the current outputs of said current mirror circuit;

a first resistor coupled in series with one of said first and second MOS transistors, the first resistor being driven by said current mirror circuit; and an output terminal coupled to said current mirror circuit for outputting a constant voltage.

9. The reference voltage generating circuit as claimed in claim 8 wherein said first MOS transistor has its drain directly connected to its gate and said second MOS transistor has its source directly grounded via the first resistor.

10. The reference voltage generating circuit as claimed in claim 8 wherein said output terminal is connected to the gate of said first MOS transistor.

11. The reference voltage generating circuit as claimed in claim 8 including a second resistor serially connected with the first resistor between the first output of the current mirror circuit and the drain of the first MOS transistor wherein said output terminal is connected between said first and second resistors.

12. The reference voltage generating circuit, as claimed in claim 8 wherein said second MOS transistor has its drain connected to said current mirror circuit via the first resistor, and said output terminal is connected between said first resistor and said current mirror circuit.

13. The reference voltage generating circuit as claimed in claim 8 wherein said current mirror circuit, said first and second MOS transistors, and said resistor are fabricated on a CMOS integrated circuit using MOS technology and provide means for reducing temperature variations in the constant voltage.

14. A reference voltage generating circuit with temperature stability for use in CMOS integrated circuits, the reference voltage generating circuit comprising:

first and second transistors having an emitter size ratio of $1:K_1$, $K_1$ being a constant, and commonly connected bases for configuring the first and second transistors to operate as a diode, wherein the first and second transistors are parasitic bipolar transistors produced using a MOS process;

first and second current mirror circuits each having two paired P channel FET's having a capacity ratio is $K_2:1$, $K_2$ being a constant, wherein FET's of equal capacities in said first and second current mirror circuits are connected to each other in series, an output end of serial connected FET's having a capacity of $K_2$ is connected via a first resistor to the emitter of the first transistor, whose emitter size ratio is 1, and an output end of the FET's whose capacity is 1 is connected via a series circuit of second and third resistors to the emitter of the second transistor, whose emitter size ratio is $K_1$, wherein said first and second transistors and said first and second current mirror circuits are fabricated on a CMOS integrated circuit using MOS technology and provide means for reducing temperature variations.

* * * * *